US006574842B2

(12) United States Patent
Brenner et al.

(10) Patent No.: US 6,574,842 B2
(45) Date of Patent: Jun. 10, 2003

(54) METHOD FOR PRODUCING AN ULTRASONIC TRANSDUCER

(75) Inventors: Alex Brenner, Bremen (DE); Rainer Busch, Oldenburg (DE)

(73) Assignee: STN Atlas Elecktronic GmbH, Bremen (DE)

( * ) Notice: Subject to any disclaimer, the term of this patent is extended or adjusted under 35 U.S.C. 154(b) by 0 days.

(21) Appl. No.: 10/047,111

(22) Filed: Jan. 17, 2002

(65) Prior Publication Data

US 2002/0063495 A1 May 30, 2002

Related U.S. Application Data

(63) Continuation of application No. 09/978,786, filed on Oct. 18, 2001, now abandoned.

(30) Foreign Application Priority Data

Oct. 24, 2000 (DE) ..... 100 52 636

(51) Int. Cl.[7] ..... H04R 17/00

(52) U.S. Cl. ..... 29/25.35; 29/25.35; 29/593; 29/594; 29/854

(58) Field of Search ..... 29/594, 25.35, 29/854, 593, 25.42, 742, 564, 564.2, 25.41; 156/154, 293, 294; 264/261, 268, 272.16, 265; 310/369, 357, 334; 427/600, 434.6, 443.2, 560

(56) References Cited

U.S. PATENT DOCUMENTS 5,539,965 A 7/1996 Safari et al.
5,929,337 A * 7/1999 Collins et al. ..... 73/597
5,950,291 A 9/1999 Gentilman et al.
6,054,177 A * 4/2000 Endoh et al. ..... 427/203
6,301,761 B1 * 10/2001 Brenner et al. ..... 29/25.35

FOREIGN PATENT DOCUMENTS

| | | |
|---|---|---|
| EP | 0694338 A 2 | 1/1995 |
| WO | WO95/0632 | 2/1995 |
| WO | WO99/48621 | 9/1999 |

* cited by examiner

*Primary Examiner*—Carl J. Arbes
*Assistant Examiner*—Tai V Nguyen
(74) *Attorney, Agent, or Firm*—Venable, LLP; Norman N. Kunitz

(57) ABSTRACT

A method for producing an ultrasound transducer having piezoelectric or electrostrictive ceramic elements (11) embedded in plastic, with reduced production costs. The ceramic elements (11) are ceramic rods (20) provided with a plastic jacket (21) of a constant thickness, and the jacketed ceramic rods (20) are organized, while standing upright, in a container (31) that is open on one side and is vibrated. The container (31), with the jacketed ceramic rods (20) is filled with a plastic, such as resin or PU. After hardening, the resulting composite body (12) is removed from the container (31), and its top side and/or underside (121, 122) is ground down until the ceramic rods (20) possess a length stipulated by the necessary transducer frequency. Electrodes contacting all or only groups of the ceramic rods (20) are subsequently mounted to the topside and underside (121, 122) of the composite body.

9 Claims, 3 Drawing Sheets

METHOD FOR PRODUCING AN ULTRASONIC TRANSDUCER

CROSS REFERENCE TO RELATED APPLICATION

This application is a continuation of U.S. application Ser. No. 09/978,786 filed Oct. 18, 2001 now abandoned.

This application claims the priority of German patent application No. 100 52 636.5 filed Oct. 24, 2000, which is incorporated herein by reference.

BACKGROUND OF THE INVENTION

The invention relates to a method for producing an ultrasound transducer of the type having a composite body that is comprised of plastic with a plurality of embedded piezoelectric or electrostrictive ceramic elements extending between the top side and the underside of the composite body, and electrodes that contact the ceramic elements on the top side and underside of the composite body.

A known ultrasound transducer of this type (U.S. Pat. No. 5,950,291), referred to as a composite acoustic transducer, has a plurality of ceramic elements comprising a piezoelectric or electrostrictive ceramic material, e.g., PZT, which are disposed in matrix fashion (1–3 composites). The ceramic elements are embedded in a rigid polymer layer, and form a composite body with this layer. The composite body is coated on its top side and underside with an electrode that contacts the ceramic elements extending between the top side and underside.

In the production of this ultrasound transducer, a ceramic body formed by an array of individual, columnar ceramic elements that protrude at a right angle from a ceramic base is placed into a casting mold, and the mold is filled to a specified level with a polymer that occupies the empty spaces between the ceramic elements. After the plastic has hardened, a solid plastic layer covers the ceramic base and surrounds the lower region of the ceramic elements. The partially-cast ceramic body is removed from the casting mold, rotated by 180° and re-inserted into the mold, with the free ends of the ceramic elements being supported on the floor of the casting mold. The polymer is again poured into the casting mold to a certain level. After the plastic layer has hardened, the cast ceramic body is removed from the mold and the ceramic base is severed. The composite body formed in this manner is coated on its top side and underside with the electrodes.

The ceramic body having a plurality of ceramic elements that project from the ceramic base is obtained either through a casting process or the sawing of a ceramic block. In the latter case, the saw blade is inserted crosswise, and only so deep that the lower ceramic base remains. The casting method requires the ceramic elements to be conical for the removal of the ceramic body from the mold, so the ceramic elements cannot possess a constant cross-section over their length. The drawback of the sawing method lies in the high reject rate. The individual sawed ceramic elements shatter easily due to the brittleness of the ceramic material, thus rendering the entire ceramic body unusable.

SUMMARY OF THE INVENTION

It is the object of the invention to simplify and reduce the costs of the method for producing the ultrasound transducer described at the outset, thereby attaining a low reject quota, for lowering the costs of mass-producing the transducer.

In accordance with the invention, the above object generally is achieved by a method for producing an ultrasound transducer, the transducer having a composite body that comprises a plastic matrix with a plurality of embedded piezoelectric or electrostrictive ceramic elements extending between the top side and the underside of the composite body, and electrodes that contact the ceramic elements on the top side and underside of the composite body, with the method comprising the following method steps;

- producing the ceramic elements as ceramic rods provided with a plastic jacket of a constant thickness,
- conveying the jacketed ceramic rods to a container that is open on one side and is subjected to vibratory movements;
- arranging the jacketed ceramic rods inside the container, while standing upright, by the vibratory movements of the container;
- filling the container containing the jacketed ceramic rods with a plastic by bubbleless casting;
- hardening the plastic to form a composite body and then removing the resulting composite body from the container;
- grinding down at least one of a top side and an underside of the composite body until the ceramic rods possess a length stipulated by the working frequency of the ultrasound transducer; and
- mounting the electrodes to the topside and underside of the composite body such that they contact all or only groups of the ceramic rods.

The method according to the invention has the advantage that the plastic-jacketed ceramic rods, whose cross-sectional profile can be round or polygonal and can be solid or hollow, can line up in matrix fashion when in the upright position due to simple vibratory movements, with the virtually constant thickness of the plastic jacket assuring a sufficiently constant spacing between the individual ceramic rods. After hardening, the plastic that fills the gaps between the rows of ceramic rods in the bubbleless casting, and is preferably a polymer such as resin or polyurethane, binds the jacketed ceramic rods securely to one another, thereby creating a composite body that either already possesses the desired shape or can be cut or sawed to the desired shape.

Practical embodiments of the method of the invention, with advantageous modifications and embodiments of the invention, likewise are disclosed.

In accordance with an advantageous embodiment of the invention, the plastic-jacketed ceramic rods are obtained as follows: Ceramic threads produced through spinning are cut into thread segments of the required length of the ceramic rods, plus some excess, and then polarized. They are then provided with a uniform plastic coating while moving in an immersion bath.

In accordance with an alternative embodiment of the invention, the ceramic threads can first be jacketed with the plastic layer of constant thickness in an immersion bath, and the thread segments forming the completely-jacketed ceramic rods can then be cut to the required length, plus some excess. In this instance, a high-temperature-proof plastic must be selected for the jacket, because the jacketed ceramic rods must still be polarized in a hot oil bath.

In accordance with an advantageous embodiment of the invention, the container exposed to the vibratory movements is covered with a perforated mask, whose holes have a slightly larger cross-section than the cross-section of the jacketed ceramic rods. A perforated mask of this type facilitates the vertical orientation and arrangement of the jacketed ceramic rods in the container. The perforated mask is removed before the jacketed ceramic rods that were aligned in the container are cast.

An ultrasound transducer produced in accordance with the method of the invention likewise is disclosed.

The invention is described in detail below using an exemplary embodiment illustrated in the drawings.

DESCRIPTION OF THE PREFERRED EMBODIMENTS

Figure 3:
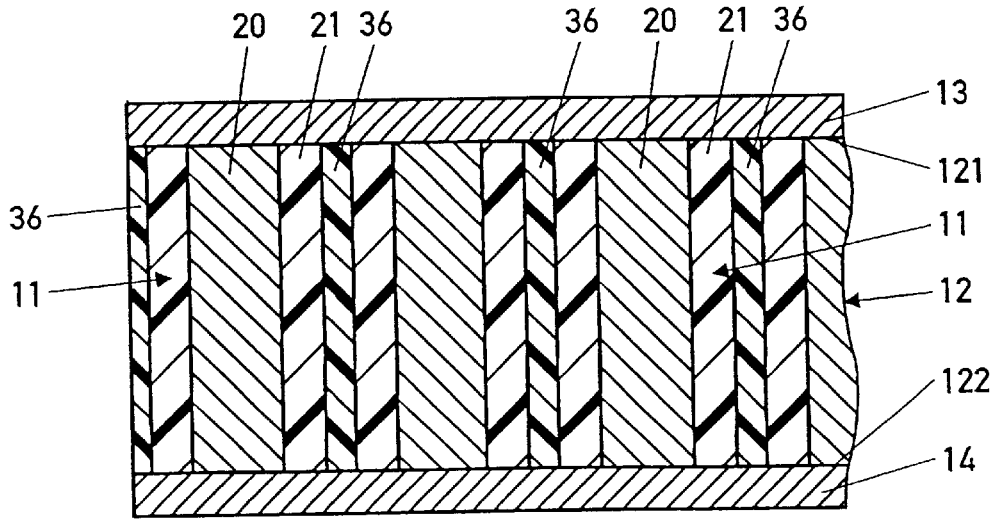
FIG. 3 is a section through the completed ultrasound transducer along the sectional line III—III in FIG. 2.

The ultrasound transducer shown in a cross-section in FIG. 3 has a composite body 12 with a plurality of small ceramic elements 11 that comprise piezoelectric or electrostrictive ceramic and are fixedly embedded with spacing in plastic, thereby extending between the top side and underside 121, 122 of the composite body 12. The ceramic elements 11 are columnar and have a round or polygonal, solid or hollow cross-sectional profile, and extend essentially parallel to one another. A slight misalignment can, however, increase the bandwidth of the ultrasound transducer. A respective electrode 13, or 14, in the form of a film of an electrically-conductive material, is respectively mounted to the top and bottom sides 121, 122 of the composite body 12, at which the end faces of the ceramic elements 11 are readily accessible. In FIG. 3, the electrode material completely covers the two sides 121, 122 and contacts all of the ceramic elements 11.

Figure 1:
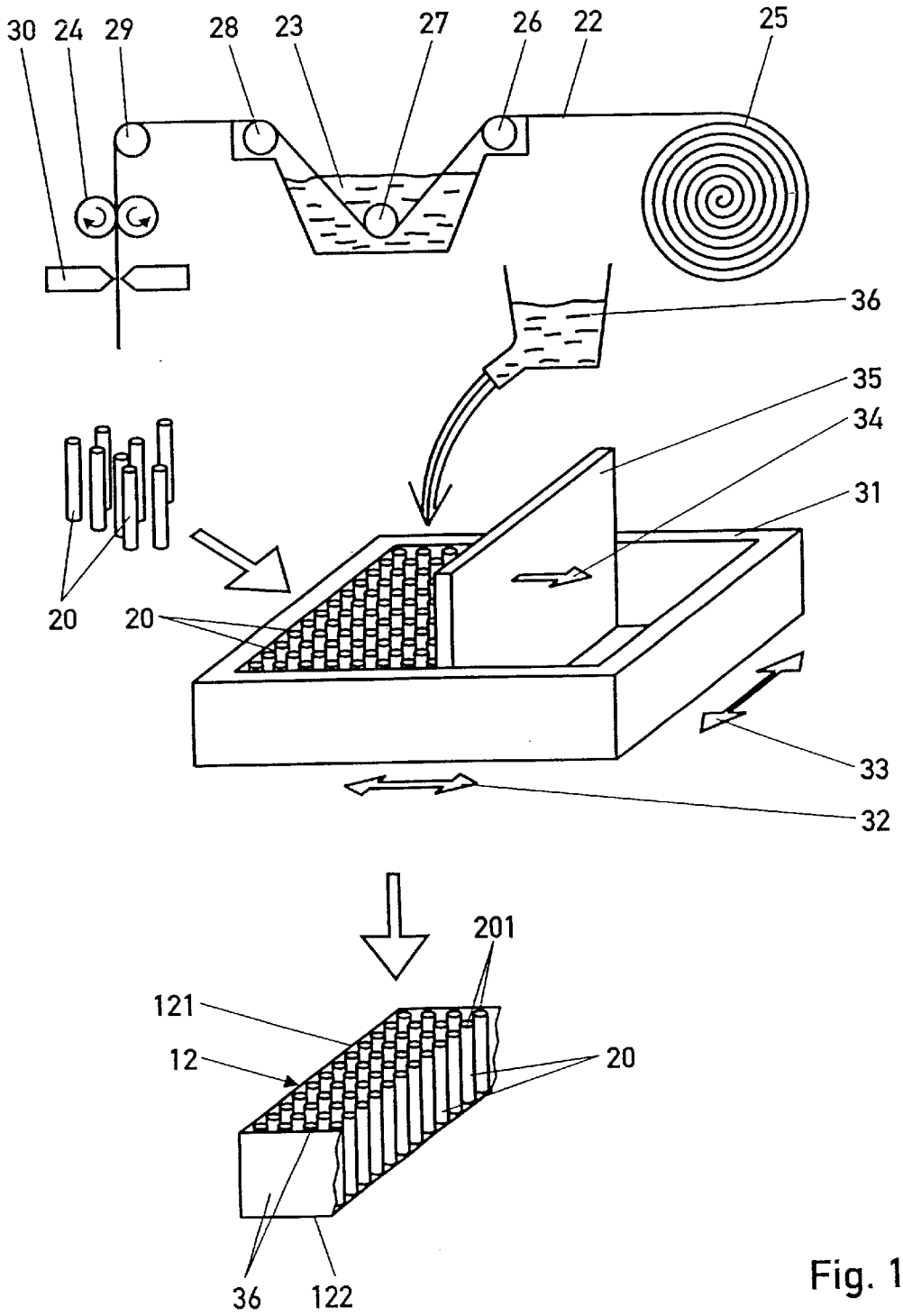
FIG. 1 a schematic representation of the method of producing an ultrasound transducer according to the invention.
Figure 2:
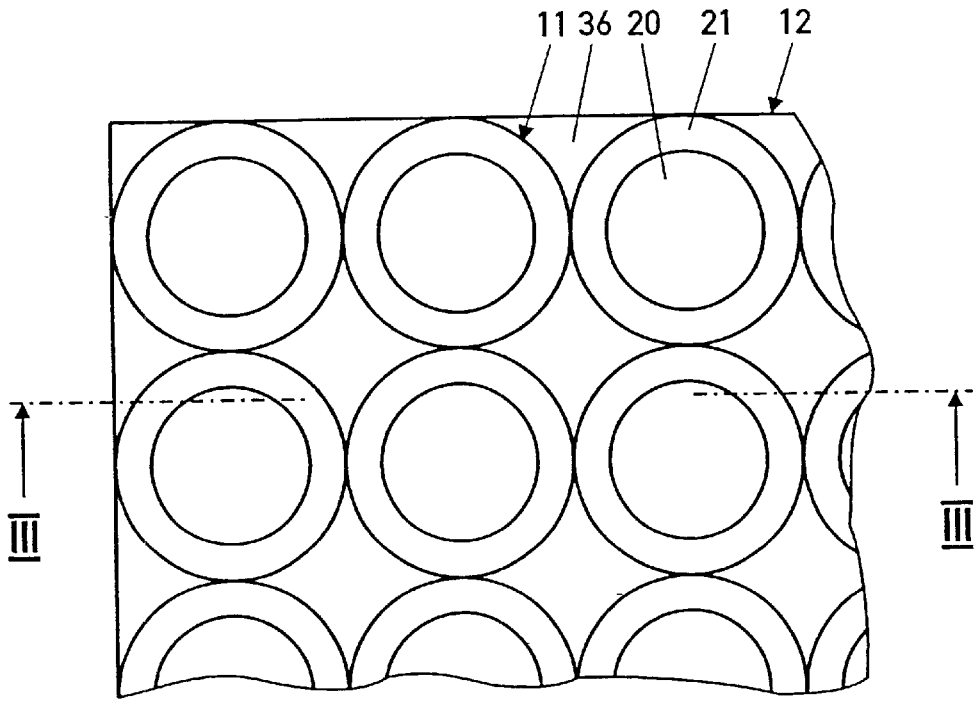
FIG. 2 is a cutaway, plan view of a composite body of the ultrasound transducer produced in accordance with the method illustrated in FIG. 1.

For reducing production costs, the ultrasound transducer of FIG. 3 is produced in accordance with the following method illustrated in FIG. 1:

The ceramic elements 11 having the aforementioned profile shapes initially are produced as thin, jacketed ceramic rods 20 whose jacket or covering 21 comprises a plastic layer having a constant thickness. As illustrated in FIG. 1 for the exemplary embodiment of the production process, a ceramic thread 22 that was produced through spinning, and whose thread thickness can be reduced to about 10 $\mu$m, is coated with the plastic jacket 21 in an immersion bath 23. As indicated by way of example in FIG. 1, the ceramic thread 22 is drawn from a supply spool 25 by a pair of drive rollers 24, which press the ceramic thread 22 with a frictional force, and is guided by diverting rollers 26–29 through the immersion bath 23 to the drive rollers 24. In the immersion bath 23, the plastic jacket 21, comprising a high-temperature-proof plastic, is deposited with a constant layer thickness onto the ceramic thread 22 as the thread is moved through the bath. A cutting blade 30 cuts the jacketed ceramic thread 22 to the required length for the ceramic elements 11, plus some excess. After being cut and polarized in a hot oil bath, the thread segments constitute the jacketed ceramic rods 20. The utilized ceramic thread 22 can have a solid or hollow profile with an arbitrary round or polygonal shape.

The jacketed ceramic rods 20 are conveyed to a box-shaped container 31, which is open on a top side and, as indicated by arrows 32, 33 in FIG. 1, is exposed to vibratory movements. In the container 31, these vibratory movements organize the jacketed ceramic rods 20, which were conveyed in an essentially upright position, as shown in FIG. 1. For the container 31 to be filled reliably with ceramic rods 20—which is comparable to the automated packaging of cigarettes in a pack—independently of the size of the container 31, a partition 35 that can be displaced in the container 31 in the direction of the arrow 34 always makes only a portion of the container 31 available for filling. The jacketed ceramic rods 20 are thereby conveyed directly up to the partition 35, and the partition 35 is displaced in the direction of the arrow 34 as the number of jacketed ceramic rods 20 increases, until the container 31 is completely filled.

At the end of the filling process for the container 31, all of the jacketed ceramic rods 20 are oriented in matrix fashion in rows and lines or columns, with their plastic jackets 21 touching. The container 31 is then bottom-cast with a plastic 36, e.g., a resin or a polyurethane (PU), which is poured into the container until the plastic 36 completely fills the spaces between the touching, jacketed ceramic rods 20, and produces a fixed connection to the plastic jackets 21 of the jacketed ceramic rods 20.

After the cast plastic 36 has hardened, the formed composite body 12 is removed from the container 31. The composite body 12 removed from the container 31 is shown in a cutaway view at the bottom of FIG. 1. To attain the required working frequency of the ultrasound transducer, the top side 121 and/or the underside 122 of the composite body 12 is or are ground down until the ceramic rods 20 possess a length stipulated by the required transducer frequency.

Figure 4:
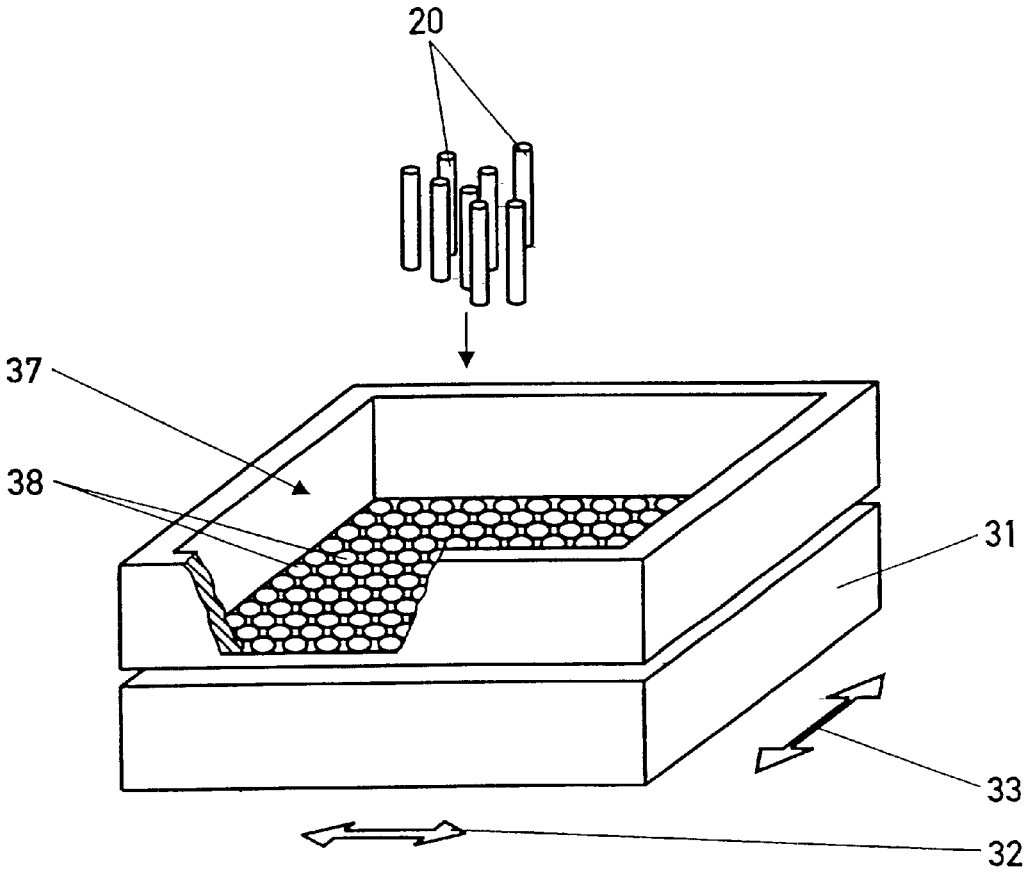
FIG. 4 shows a modification of the production method illustrated in FIG. 1.

As shown in FIG. 4, to accelerate the process of filling the container 31 with jacketed ceramic rods 20, the open top side of the container 31 can be covered with a perforated mask 37, whose holes 38 have a slightly larger cross-section than the jacketed ceramic rods 20. The holes 38 are arranged in matrix fashion in rows and lines or columns, and define the position of the jacketed ceramic rods 20 in the container 31. The jacketed ceramic rods 20 are now placed into the container 31 through the holes of the perforated mask 37, with the orientation and arrangement of the jacketed ceramic rods 20 in the container 31 being established by the perforated mask 37, which is also exposed to vibratory movements (arrows 32, 33). The perforated mask 37 is removed for pouring the plastic 36 into the container 31 filled with the jacketed ceramic rods 20.

The invention is not limited to the above-described exemplary embodiment. Unlike in the embodiment shown at the top of FIG. 1 for producing the jacketed ceramic rods 20, the spun ceramic thread 22 initially is cut into thread segments of the length required for the ceramic rods 20, plus some excess. The cut thread segments are polarized, and then move in an immersion bath 23 while being coated with a plastic layer of a constant layer thickness, which becomes the plastic jacket 21. The jacketed ceramic rods 20 produced in this manner are then further processed to form the composite body 12, as described above and illustrated in FIG. 1.

Instead of the fairly thin, jacketed ceramic rods 20 obtained from ceramic threads, ceramic rods having a larger cross-section and a diameter in the millimeter range can also be used. These rods, which are also cut to the prescribed length plus some excess, are moved in an immersion bath and thereby provided with the plastic jacket of a constant thickness, with the thickness again being selected to correspond to the fullness factor of the composite body 12. In principle, regardless of the cross-sectional dimension of the ceramic elements 11, the cross-section of the ceramic rods 20 or larger ceramic rods is adapted to the clear cross-section of the container 31 such that the ratio of ceramic material to plastic material in the composite body 12 is optimized for the desired working-frequency range of the ultrasound transducer. With a relatively large working-frequency range of the ultrasound transducer, for example of about 100 kHz, the fullness factor of ceramic material in the composite body 12 is established at 40–60%.

The dimensions of the container 31 are preferably selected to correspond to the predetermined dimensions of the composite body 12, so the composite body 12 ground down to the nominal frequency need only be coated with the electrodes 13, 14, as shown in FIG. 3. As an alternative, the container 31 can have a fixed, standard size, so the described production process always yields composite bodies 12 with fixed dimensions. The individual required dimensions are then attained by cutting or sawing the composite body 12, and the composite body 12 processed in this manner is completed with the electrodes 13, 14.

The ultrasound transducer shown in section in FIG. 3 represents an electroacoustic transducer element that is typically combined with further, similar transducer elements to form a larger arrangement, referred to as a base or an array, of equidistantly-spaced transducer elements. The horizontal and vertical opening angles of the transducer element are determined by the length and width of the composite body 12, and the working frequency of the transducer element is predetermined by the distance between the top side 121 and underside 122 of the composite body 12. The length and width dimensions of the composite body 12 are typically between 1 and 50 mm.

Figure 5:
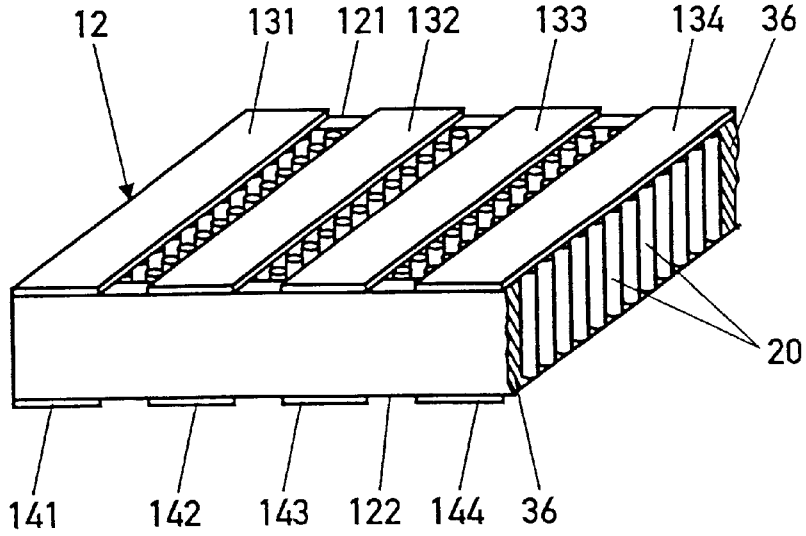
FIG. 5 is a cutaway, perspective view of an ultrasound transducer in accordance with a further exemplary embodiment.

It is, however, also possible to realize a plurality of such transducer elements in the ultrasound transducer by increasing the length and width dimensions of the composite body 12 and structuring the electrodes 13, 14 such that only groups of ceramic rods 20 are contacted at the end face. The top side 121 and the underside 122 of the composite body 12 can be coated with the electrodes 131–134 in the manner illustrated schematically in FIG. 5. Instead of this linear structuring of the electrodes 13, 14, other structures, such as an annular structure, can be considered, depending on the respective scenario.

The invention now being fully described, it will be apparent to one of ordinary skill in the art that many changes and modifications can be made thereto without departing from the spirit or scope of the invention as set forth herein.

What is claimed is:

1. A method for producing an ultrasound transducer, the transducer having a composite body that comprises a plastic matrix with a plurality of embedded piezoelectric or electrostrictive ceramic elements extending between a top side and an underside of the composite body, and electrodes that contact the ceramic elements on the top side and the underside of the composite body, said method comprising the following method steps:

producing the ceramic elements as ceramic rods provided with a plastic jacket of a constant thickness;

conveying the jacketed ceramic rods to a container that is open on one side and is subjected to vibratory movements;

arranging the jacketed ceramic rods inside the container, while standing upright, by the vibratory movements of the container;

filling the container containing the jacketed ceramic rods with a plastic by bubbleless casting;

hardening the plastic to form a composite body and then removing the resulting composite body from the container;

grinding down at least one of a top side and an underside of the composite body until the ceramic rods possess a length stipulated by a working frequency of the ultrasound transducer; and mounting the electrodes to the top side and the underside of the composite body such that they contact all or only groups of the ceramic rods.

2. The method according to claim 1, wherein the resin is a plastic or polyurethane.

3. The method according to claim 1, wherein inside dimensions of the container are chosen to correspond to desired dimensions of the composite body.

4. The method according to claim 1, wherein inside dimensions of the container are chosen independently of dimensions of the composite body, and the composite body is subsequently cut to a proper shape.

5. The method according to claims 1 further comprising prior to said step of conveying, covering the container subjected to vibratory movements with a perforated mask that defines a position of the jacketed ceramic rods in the container, with holes in the perforated mask possessing a slightly larger cross-section than a cross-section of the jacketed ceramic rods; and, removing the perforated mask prior to the step of filling the container with the plastic.

6. The method according to claim 1, wherein said step of producing includes: moving a spun ceramic thread through a plastic immersion bath to provide the spun ceramic thread with a plastic jacket layer of a constant thickness; and then cutting the spun ceramic thread with the plastic jacketed layer into the jacketed ceramic rods of required length.

7. The method according to claim 1, wherein the step of producing includes: cutting a spun ceramic thread into thread segments of a required length, plus some excess, placing the thread segments in an immersion bath of plastic for applying the plastic jacket to produce the jacketed ceramic rods.

8. The method according to claim 1, further including; selecting a cross-section of the ceramic rods relative to the clear cross-section of the container such that a ratio of ceramic material to plastic material is attained in the composite body that is optimal for a working-frequency range of the ultrasound transducer to be produced.

9. The method according to claim 8, wherein the cross-section of the ceramic rods is selected with consideration of a necessary mutual spacing established by the thickness of the plastic jackets such that the fullness factor of the ceramic material in the composite body is 40 to 60%.

* * * * *